US007716894B2

(12) United States Patent
Jolitz

(10) Patent No.: US 7,716,894 B2
(45) Date of Patent: May 18, 2010

(54) STARTER BLOCK ROOFING PRODUCT

(75) Inventor: Randal J. Jolitz, Joplin, MO (US)

(73) Assignee: EPOCH Composite Products, Inc., Joplin, MO (US)

( * ) Notice: Subject to any disclaimer, the term of this patent is extended or adjusted under 35 U.S.C. 154(b) by 1367 days.

(21) Appl. No.: 10/757,145

(22) Filed: Jan. 14, 2004

(65) Prior Publication Data

US 2005/0166511 A1 Aug. 4, 2005

(51) Int. Cl.
*E04D 1/30* (2006.01)
*E04D 1/00* (2006.01)

(52) U.S. Cl. ..... 52/535; 52/518; 52/519; 52/521; 52/522; 52/547; 52/553

(58) Field of Classification Search ..... 52/518–527, 52/535, 540, 543–544, 98, 103, 105, 529, 52/536, 538, 539, 541–542, 546–547, 548, 52/557, 553, 558; 254/104
See application file for complete search history.

(56) References Cited

U.S. PATENT DOCUMENTS

| | | | | | |
|---|---|---|---|---|---|
| 1,521,893 | A | | 5/1925 | Kridler et al. | |
| 2,142,996 | A | * | 1/1939 | Bussey | 52/521 |
| 2,193,233 | A | * | 3/1940 | Hardy | 264/34 |
| 2,205,307 | A | | 6/1940 | Parsons | |
| 3,626,439 | A | | 12/1971 | Kneisel | |
| 3,693,305 | A | | 9/1972 | Kneidel | |
| 3,852,934 | A | * | 12/1974 | Kirkhuff | 52/539 |
| 4,015,392 | A | | 4/1977 | Eaton | |
| 4,065,899 | A | | 1/1978 | Kirkhuff | |
| 4,191,722 | A | | 3/1980 | Gould | |
| 4,279,106 | A | * | 7/1981 | Gleason et al. | 52/100 |
| 4,437,274 | A | | 3/1984 | Slocum et al. | |
| 4,856,237 | A | * | 8/1989 | Wigle | 52/12 |
| 5,953,862 | A | * | 9/1999 | Earhart et al. | 52/98 |
| 6,199,338 | B1 | * | 3/2001 | Hudson et al. | 52/518 |
| 6,338,230 | B1 | * | 1/2002 | Davey | 52/518 |
| 6,354,058 | B1 | * | 3/2002 | Lewis | 52/749.11 |
| 6,874,289 | B2 | * | 4/2005 | Koch et al. | 52/543 |
| 6,924,015 | B2 | * | 8/2005 | Zanchetta et al. | 428/40.1 |

* cited by examiner

*Primary Examiner*—Jeanette Chapman
(74) *Attorney, Agent, or Firm*—Husch Blackwell Sanders LLP

(57) ABSTRACT

The present invention generally encompasses a starter block for use in the starter course of a roofing project to facilitate the subsequent positioning of shingles upon a hip roof without causing said shingles to substantially bend. The starter block has a tapered thickness, that is, the height of the front surface is greater than the height of the back surface. In one embodiment, the height of the front surface is about twice the height of the back surface. Otherwise, the starter block is generally rectangular. In one embodiment, the starter block is formed from a composite material, such as a combination of at least a polymer component (e.g. polyethylene) and a filler component (e.g., glass, stone, limestone), and includes at least one nib extending from each of its side surfaces and at least one nailing zone on its top surface. A roofing system that incorporates a course of the starter blocks coupled to the eaves of the roof and at least one course of shingles positioned to lie flat on and at least partially overlap the course of starter blocks with the shingles extending back to the upper surface of the roof without substantially bending or flexing the shingles in the one course is also provided.

23 Claims, 2 Drawing Sheets

STARTER BLOCK ROOFING PRODUCT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a roofing product. More specifically, the present invention provides a tapered starter block for use in the starter course of a roofing project.

There are many types of roofing shingles including asphalt, wood shake, slate and composite shingles. Many of these shingles have some structural rigidity. For example, slate, wood shake and some types of composite shingles will not substantially flex or bend. Other types of composite shingles will bend a short distance if forced but at a cost of increased stress at the area where the shingle is bent. Typical asphalt shingles have little structural rigidity.

When installing a roofing system, a roofer will likely begin by coupling a starter course along the eaves of the roof to form a base for the first course of full shingles. Often, the starter course is composed of shingles that have been cut so that they have a shorter length than the standard shingle. For shingles with less structural rigidity, a single layer of cut shingles is generally sufficient for the starter course.

For shingles with more than a little structural rigidity, however, if only one layer of shingles is used for the starter course, then the shingles in the first course will not lie flat on the starter course while maintaining some contact with the roof behind the starter course. Thus, when the second course of shingles is installed, the first course shingles will extend above the starter course so that there is some distance or gap between the bottom of the first course shingle and the top or upper surface of the starter course. To avoid this problem, a roofer may couple the front portion of a first course shingle to the starter course in addition to coupling the back portion of the shingle to the roof, thereby causing the first course shingle to bend along the back edge of the starter course. Of course, a roofer may employ this method only when the shingles are capable of bending and, even then, bending the shingle places unnecessary stress on the shingle at the bend line that may lead to premature failure.

Roofers have developed several methods to address the above-stated problem. One solution is for a roofer to cut an additional number of shingles into even smaller sections and install those sections in a second layer on top of and towards the front of the starter course in order to fill the distance between the first course shingles and the starter course. Unfortunately, this is not an optimal solution because it increases both the shingles required for the project and the time required to complete the roof.

Another method developed by roofers is to cut a piece of lumber or other solid building material into a starter strip and then use the strip along the eaves of the roof to form the starter course. Typically, the starter strip is made as long as possible, and usually significantly longer than traditional shingles, so that the fewest number of strips are required. However, because each type of shingle may be sized differently, it is difficult to create a standard wooden starter strip that would work with different types of shingle. In addition, care must be taken when installing the first course shingles to insure that the shingles completely cover the starter strip. As with the previous method, this solution is not optimal because of the extra time, effort, material and expense required to produce the strips.

Finally, some simulated shingles are designed so that they have some type of interlocking joint or contour structure that allows the back end of one shingle to fit together with the front end of a later installed shingle course when the shingles are installed. Occasionally, these shingles will have an accompanying starter product for installation at the roof eaves. It should be understood that these starter strips include the same interlocking joint or contour structure as the regular shingles, and, therefore, are not suitable for use with other types of shingles.

Therefore, it would be beneficial to provide a product that would prevent the problems described above. More specifically, it is beneficial to provide a product that could be used to eliminate any gap between the front portion of the first course shingles and the upper or top surface of the product underlying the first course shingle and/or any gap between the back of the first course shingle and the roof so that the first course shingles may be installed without substantially bending or breaking. Additionally, it would be beneficial to provide a product that accomplishes the above and that is usable with different types of shingles and capable of being produced in numbers.

SUMMARY OF THE INVENTION

In order to overcome the above stated problem, the present invention generally provides a starter block for use in the starter course of a roofing project. The starter block is formed from a composite material and, therefore, may be mass-produced and may be finished in a number of ways. For example, the starter block may be finished so that it has the appearance of a slate shingle. In one embodiment, the starter block is formed from at least a polymer component (e.g. polyethylene) and a filler component (e.g., glass, stone, limestone).

The starter block of the present invention has a tapered thickness, that is, the height of the front surface is greater than the height of the back surface. In one preferred embodiment, the height of the front surface is about twice the height of the back surface. Otherwise, the starter block is generally rectangular, with the width of the starter block consistent with the width of a shingle so that the starter block is easy to use.

In one embodiment, the starter block of the present invention includes nailing zones on its top surface. The nailing zones, which indicate where a roofer may apply nails to couple the starter block to a roof, may be indented or non-indented.

In another embodiment, the starter block of the present invention includes at least one nib or tab extending from a side surface. These nibs assist in aligning adjacent starter blocks and ensure that the roofer includes proper spacing between starter blocks.

Additional advantages and novel features of the present invention will in part be set forth in the description that follows or become apparent to those who consider the attached figures or practice the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

The present invention provides a starter block for use in the starter course of a roofing project to facilitate the subsequent positioning of shingles on the roof. More specifically, the starter block of the present invention allows the shingles to be positioned without substantially bending, stressing or breaking the shingles. The starter block, which is formed from a composite material, has a tapered thickness with a front surface height that is greater than the back surface height. Apart from the tapered thickness, the starter block has a size that is consistent with a shingle for ease of use.

Figure 1:
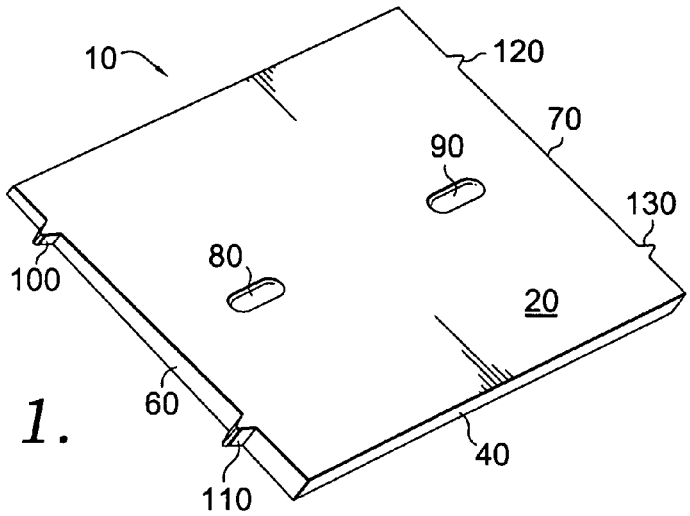
FIG. 1 is a perspective view of a starter block according to one embodiment of the present invention.
Figure 2:
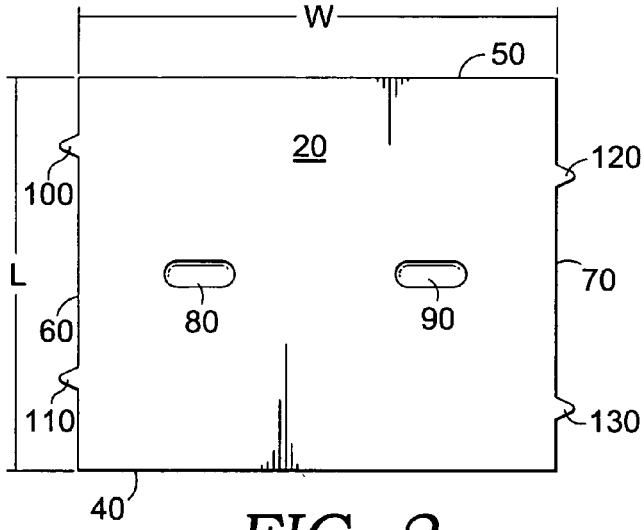
FIG. 2 is a top view of the starter block of FIG. 1.
Figure 3:
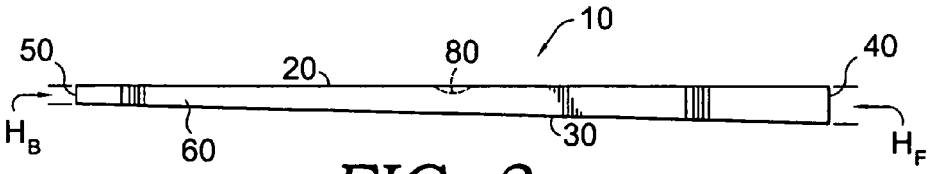
FIG. 3 is a side view of the starter block of FIG. 1.

As seen in FIGS. 1, 2 and 3, one embodiment of the starter block of the present invention is generally denominated by the numeral 10. Starter block 10 includes a top surface 20, a bottom surface 30, a front surface 40 and a back surface 50. These surfaces are generally rectangular. In the embodiment of the present invention shown in these figures, the starter block is a solid. The present invention, however, is not limited to solid structures. Thus, for example, the scope of the present invention includes a starter block having a cavity defined in bottom surface 30, which would require less material to make than a solid starter block.

Continuing with the figures, starter block 10 includes two non-rectangular side surfaces 60 and 70. (Only side surface 60 is shown in FIGS. 1 and 3.) As seen in FIG. 3, the height $H_F$ of front surface 40 is greater than the height $H_B$ of back surface 50. Accordingly, the heights of side surfaces 60 and 70 decrease or taper from the front of starter block 10 to the back.

Starter block 10 also may include one or more indented or non-indented nailing zones 80, 90 located on top surface 20. Nailing zones 80 and 90 are areas in which starter block 10 can be fastened to a roof by using a nail or any other suitable device. Nailing zones 80 and 90 are generally positioned on top surface 20 so that starter block 10 will be adequately secured to the roof, and also so that the nailing zones 80 and 90 are covered by an overlaying shingle. While nailing zones 80 and 90 are shown as curved rectangles, it will be understood that other shapes may be implemented in the present invention.

Starter block 10 (FIGS. 1 and 2) may also include one or more nibs or tabs 100, 110, 120, and 130 extending from side surfaces 60 and 70 respectfully. In particular, each of nibs 100, 110, 120, and 130 may generally include an apex or pointed end that extends outwardly from side surfaces 60 and 70 respectively. It will be understood that the widths of nibs 100, 110, 120, and 130 preferably are approximately equal. Nibs 100 and 110 may be spaced apart at generally the same distance that separates nibs 120 and 130, however, nibs 100 and 110 will be located at a different distance from back surface 50 than nibs 120 and 130. Moreover, starter block 10 may include more than two nibs on each side, a single nib on each side, or no nibs.

Figure 4:
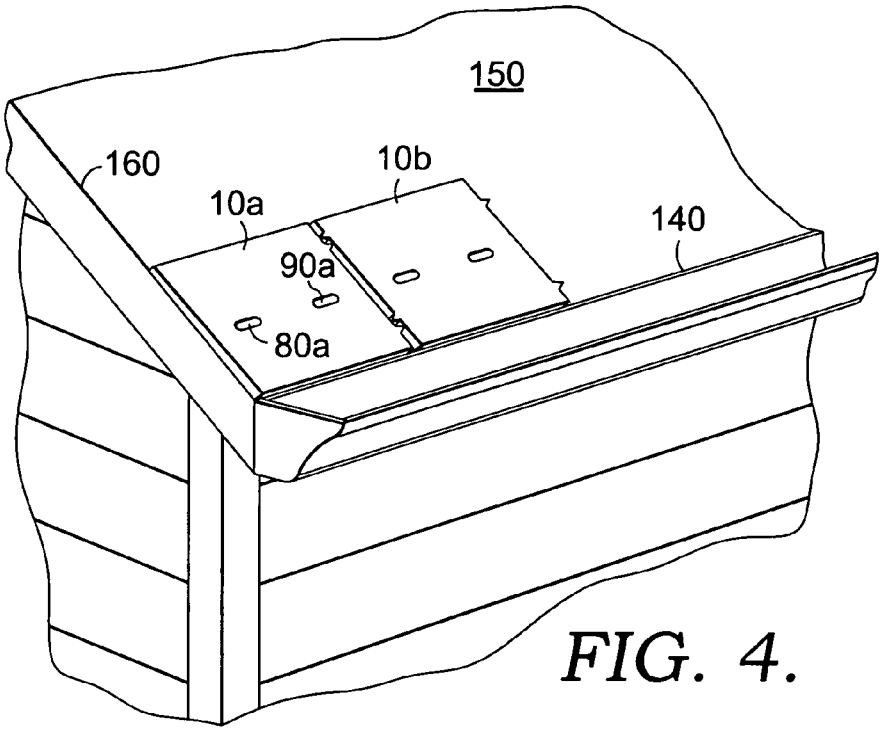
FIG. 4 is a perspective view of two starter blocks according to one embodiment of the present invention installed at the edge of a roof.

Referring now to FIG. 4, the starter block of the present invention is intended for use in conjunction with the first course of shingles in a roofing project. Thus, at the start of a roofing project, starter block 10*a* is placed at the eave 140 of roof 150 adjacent to side edge (or rake) 160. After such placement, starter block 10*a* is coupled to roof 150, most likely by applying one or more nails through starter block 10*a* and into roof 150. It should be noted that starter block 10*a* includes optional nailing zones 80*a* and 90*a*. Accordingly, the nails that couple starter block 10*a* to roof 150 most likely would penetrate starter block 10*a* at nailing zones 80*a* and 90*a*.

Next, starter block 10*b* is placed at bottom edge 140 of roof 150 adjacent to starter block 10*a*. Both starter block 10*a* and 10*b* have nibs on their adjacent side surfaces. After starter block 10*b* is placed on roof 150, it is moved horizontally until its nibs are in contact with starter block 10*a* and the nibs on starter block 10*a* are in contact with starter block 10*a*. In this manner, the nibs insure that there is proper spacing between the two starter blocks 10*a* and 10*b*. In addition, it should be noted that the nibs on the two starter blocks 10*a* and 10*b* are offset so that the nibs on one starter block do not impede the nibs on the other starter block. After starter block 10*a* is in proper position, it too is coupled to roof 150, most likely in the same manner as starter block 10*a*. Additional starter blocks may then be placed on and coupled to roof 150 until the starter course extend the entire length of eave 140.

Figure 5:
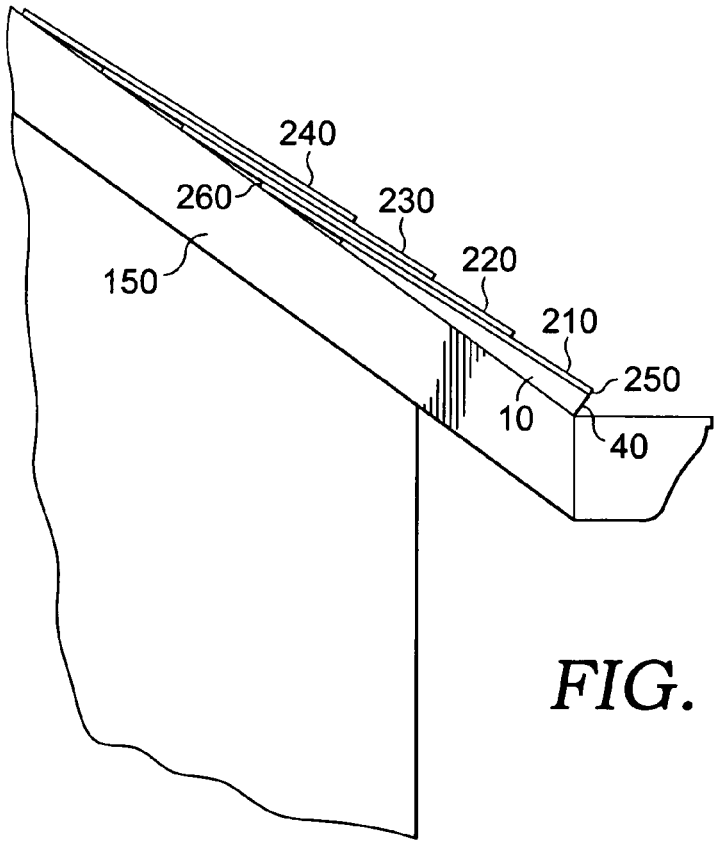
FIG. 5 is a side view of a starter blocks according to one embodiment of the present invention and four shingles applied in an overlapping fashion on a roof.

Referring now to FIG. 5, following the installation of a course of starter blocks, such as starter block 10, a roofer will install a first course of overlapping shingles. For the particular project shown in FIG. 5, the roofer has completed five courses: a course of starter blocks and four courses of shingles. Thus, the first course of shingles includes shingle 210, the second course of shingles includes shingle 220, the third course of shingles includes shingle 230, and the fourth course of shingles includes shingle 240.

Continuing with FIG. 5, for this project, the roofer has installed shingle 210 with its bottom surface lying flat on the top surface of starter block 10 and with its front surface 250 in a planar relationship with the front surface 40 of starter block 10. It is contemplated that shingle 210 could have been placed farther back from surface 40 on starter block 10 and that the location of shingle 210 on starter block 10 may be determined by the particular type of shingle and/or starter block employed. For example, as will be discussed below, in a preferred embodiment, the starter block of the present invention is made from a composite material. If such a starter block is used with slate shingles, the shingle most likely will completely cover the starter block for aesthetic purposes. However, if such a starter block is used with similarly-designed composite shingles, then the shingle may be installed so that the front part of the top surface of starter block 10 is exposed. The roofer has installed shingles 220, 230 and 240 in such a manner, that is, with the front part of the top surface of the underlying shingle exposed.

As can be seen in FIG. 5, the shape and size of starter block 10 (and in particular the tapered height of starter block 10) causes the back edge 260 of shingle 210 to be in contact with roof 150 when shingle 210 is installed overlying starter block 10. Notably, the back edge 260 of shingle 210 is in contact with roof 150 even though shingle 210 is lying flat along the length of the top surface of starter block 10 and even though shingle 210 is not bent, flexed, curved or bowed as it extends back beyond starter block 10. In other words, the shape and dimensions of starter block 10 allows shingle 210 (and likewise shingles 220, 230 and 240) to be installed so that it remains planer between its back edge 260, which is in contact with roof 150, and its front edge 250.

Utilizing dimensions from the shingles that are to be employed with the starter block, one can determine dimensions for the heights $H_F$ and $H_B$ and the length L of starter block 10. For example, certain composite shingles manufactured by Epoch Composite Products, Inc. of Joplin, Mo. have a length of 18 inches, a width of 10 inches and a generally consistent height or thickness of approximately 0.25 inches. If these shingles are to be installed with approximately 8 inches of the top surface of the underlying shingles exposed and none of the top surface of starter block 10 exposed, then an appropriate front surface height $H_F$ for starter block 10 would be approximately 0.5 inches. Moreover, if the back surface height $H_B$ of the starter block is to be approximately 0.25 inches, which is consistent with the composite shingle, then the length L of the starter block should be approximately 10 inches. The width W of the starter block is consistent with the width of the shingles.

As stated above, the first course shingles may be installed so that a portion of the top surface of starter block 10 is exposed. If the Epoch composite shingles are to be installed with approximately 8 inches of the top surface of the underlying shingle exposed and approximately 8 inches of the top surface of starter block 10 exposed, then an appropriate front surface height $H_F$ for starter block 10 would be approximately 0.8 inches. If the back surface height $H_B$ of the starter block is to be approximately 0.25 inches, then the length L of the starter block should be approximately 18 inches, which is the same as the length of the shingle. As above, the width W of the starter block is consistent with the width of the shingles.

It should be understood that several other solution sets may exist for starter block dimensions that would work well with such composite shingles. Additionally, the dimensions may be affected by economic considerations from the manufacturing and shipping processes.

It should be noted that in the previous examples, the dimensions of starter block 10 (except, of course, its height) are generally consistent with the roofing project's shingles. This allows a roofer to use the same tools and methods for installing starter block 10 as he or she will use for installing the shingles. Thus, for example, if the roofer intends to use a nail gun to nail the shingles to the roof, the roofer will be able to use a nail gun on starter block 10. Similarly, if the roofer intends move a number of shingles to the roof and then place and couple one shingle at a time, he or she may utilize the same method for the starter block. Finally, the roofer does not need a second person to assist in placing and/or holding the starter blocks to the roof.

As stated above, in one embodiment, the starter block of the present invention is a composite product. Thus, starter block 10 may be formed from suitable materials such as, but not limited to, rubber (e.g., ground up tire rubber), polymers such as polyethylene (e.g., various grades, recycled or virgin), fillers (e.g., glass, stone, limestone), asphalt embedded mats, or tile. In a preferred embodiment, the starter block is formed from a composite material that is composed of at least a polymer component and a filler component. In addition, a coloring agent may be added to the mixture so that the composite product more closely resembles a particular type of shingle. For example, for a composite slate product, a gray color may be added to the mixture. Similarly, for a composite tile product, a red color may be added to the mixture.

The starter block may be made and cut, or molded, to shape using known techniques. For example, one manner of making the starter block relies on the use of a mixer and extruder. The ingredients that are used to form the starter block are mixed in the mixer and then passed through the extruder. Thereafter, the mixture is fed to an injection-molding machine where it is injected one or more molds that have been cast or machined, such as by digitized molding, to have the desired shape of the starter block (including any textured or contoured shape for simulating certain types of shingles such as slate, tile or asphalt shingles). After it has cooled, the starter block is removed from the mold, bundled with other starter blocks or roofing products, and stored for later sale and use. Of course, as is known in the field, the above-stated steps may be automated. Moreover, many other methods of making composite versions of a starter block are also within the scope of the present invention, such as those described in U.S. patent applications Ser. Nos. 10/387,823 and 10/457,728, which are incorporated herein by reference.

The starter block of the present invention, which is formed from a composite material, is particularly suited for use in the first or starter course of a roofing product. The starter block is tapered so that shingles will lie flat on the top surface of the starter block will extend back until coming into contact with the roof without bending. In one embodiment, the height of the starter block front surface is approximately twice the height of the starter block back surface. The starter block's remaining dimensions are consistent with the roofing project's shingles so that the roofer may use the same tools and methods for installing the starter block as he or she will use for installing the shingles.

While particular embodiments of the invention have been shown, it will be understood, that the invention is not limited thereto, since modifications may be made by those skilled in the art, particularly in light of the foregoing teachings. Reasonable variation and modification are possible within the scope of the foregoing disclosure of the invention without departing from the spirit of the invention.

The invention claimed is:

1. A composite starter block having a unitary construction for facilitating the subsequent positioning of shingles upon a hip roof, said starter block comprising:

a top surface, two side surfaces, a front surface and a back surface;

wherein each of said top surface, said front surface and said back surface has a generally rectangular shape;

wherein the height of said front surface is greater than the height of said back surface;

wherein said two side surfaces are tapered; and wherein a shingle placed flat on said top surface will extend back to said roof without substantially bending.

2. The starter block of claim 1 wherein the width of said starter block is substantially equal to the width of said shingle.

3. The starter block of claim 1 wherein the length of said starter block is substantially equal to the length of said shingle.

4. The starter block of claim 1 further comprising at least one nailing zone on said top surface.

5. The starter block of claim 4 wherein said at least one nailing zone is indented into said top surface.

6. The starter block of claim 1 further comprising a first nib extending from one of said side surfaces.

7. The starter block of claim 6 further comprising a second nib extending from the opposite side surface.

8. The starter block of claim 1 wherein said composite material is a combination of at least a polymer component and a filler component.

9. The starter block of claim 1 wherein the height of said front surface is about twice the height of said back surface.

10. The starter block of claim 1 wherein the height of said front surface is 0.5 inches and said height of said back surface is 0.25 inches, and wherein the length of said top surface is 10 inches and the width of said top surface is 12 inches.

11. The starter block of claim 1 wherein said top surface is configured to resemble slate.

12. A roofing system for covering and protecting a roof, said roofing system comprising:

a course of starter blocks coupled to the eaves of said roof, with each of said starter blocks having a unitary construction and comprising a top surface, two side surfaces, a front surface and a back surface, wherein each of said top surface, said front surface and said back surface has a generally rectangular shape; wherein the height of said front surface is greater than the height of said back surface; and wherein said two side surfaces are tapered; and at least one course of shingles coupled to said roof, the first course of said shingles positioned to lie flat on and at least partially overlap said course of starter blocks with said shingles extending back to said roof without substantially bending.

13. The roofing system of claim 12 wherein the width of each of said starter blocks is substantially equal to the width of one of said shingles.

14. The roofing system of claim 12 wherein the length of each of said starter blocks is substantially equal to the length of one of said shingles.

15. The roofing system of claim 12 wherein said starter blocks each have at least one nailing zone on their top surface.

16. The roofing system claim 15 wherein said nailing zones are indented into said top surface.

17. The roofing system of claim 12 wherein said starter blocks each have a first nib extending from one of said side surfaces.

18. The roofing system of claim 17 wherein said starter blocks each have a second nib extending from the opposite side surface.

19. The roofing system of claim 12 wherein said starter blocks and said shingles are formed from a composite material.

20. The roofing system of claim 19 wherein said composite material is a combination of at least a polymer component and a filler component.

21. The roofing system of claim 19 wherein the top surface of said starter blocks and said shingles are configured to resemble slate.

22. The roofing system of claim 12 wherein the height of said starter block front surface is about twice the height of said starter block back surface.

23. The roofing system of claim 12 wherein the height of said starter block front surface is 0.5 inches and said height of said starter block back surface is 0.25 inches, and wherein the length of said starter block top surface is 10 inches and the width of said starter block top surface is 12 inches.

* * * * *